United States Patent [19]

Nillson

[11] Patent Number: 4,781,108

[45] Date of Patent: Nov. 1, 1988

[54] METHOD AND MEANS FOR SUPPLYING CLEAN AIR TO AN OPERATING ROOM

[75] Inventor: Lars A. H. Nillson, Oskarshamn, Sweden

[73] Assignee: MTD Medical Technology and Development Ltd., Nicosia, Cyprus

[21] Appl. No.: 10,191

[22] PCT Filed: Apr. 28, 1986

[86] PCT No.: PCT/SE86/00193

§ 371 Date: Dec. 23, 1986

§ 102(e) Date: Dec. 23, 1986

[87] PCT Pub. No.: WO86/06460

PCT Pub. Date: Nov. 6, 1986

[30] Foreign Application Priority Data

Apr. 26, 1985 [SE] Sweden ..... 8502043
Oct. 4, 1985 [SE] Sweden ..... 8504594

[51] Int. Cl.[4] ..... F24F 9/00
[52] U.S. Cl. ..... 98/36; 128/897
[58] Field of Search ..... 98/36, 115.3; 128/1 R

[56] References Cited

U.S. PATENT DOCUMENTS

| | | | |
|---|---|---|---|
| 3,462,920 | 8/1969 | Denny | 98/36 |
| 3,511,162 | 5/1970 | Truhan | 98/36 |
| 3,626,837 | 12/1971 | Pelosi | 98/36 |
| 3,998,142 | 12/1976 | Foreman et al. | 98/36 |
| 4,129,122 | 12/1978 | Dout et al. | 98/36 |
| 4,471,688 | 9/1984 | Smets | 98/36 |

FOREIGN PATENT DOCUMENTS

| | | |
|---|---|---|
| 2260380 | 6/1974 | Fed. Rep. of Germany . |
| 2851046 | 6/1980 | Fed. Rep. of Germany . |
| 3228401 | 2/1983 | Fed. Rep. of Germany . |
| 2120778 | 12/1983 | United Kingdom . |

*Primary Examiner*—Larry I. Schwartz
*Attorney, Agent, or Firm*—Ladas & Parry

[57] ABSTRACT

A method and a means for supplying clean or sterile air to an area intended to be kept clean or sterile in an operating room or similar. The means comprises a central supply member (10) for a central carry beam directed towards said area and at two secondary air supply members (12, 13) adapted adjacent said central supply member (10), said secondary air supply members (12, 13l) being adapted for supplying secondary air beams in an area surrounding the carry beam. The air velocity of the carry beam is greater than the air velocity of the secondary air beams. The central supply member (10) for the central carry beam comprises one or several slits (11) for directing and supplying the carry beam. Preferably, the supply member (10) is surrounded by secondary air supply members (12, 13) on either sides thereof and the air beams from the secondary air members (12, 13) are directed towards the carry beam. The central supply member (10) may be positioned in a corner about 45° upwards seen from said sterile area and surrounded by said secondary air supply members (12, 13) which extend along the ceiling and one side wall of the room, respectively for forming an mutual angle of 90°. Each secondary air supply member (12, 13) may comprise an outer angled portion (14, 15, 20, 21, 22), in whch the secondary air beams are directed somewhat outwards. Moreover, the secondary air supply members (12, 13) may be surrounded by a plate (16, 17, 18, 19) on the outer sides thereof.

11 Claims, 3 Drawing Sheets

METHOD AND MEANS FOR SUPPLYING CLEAN AIR TO AN OPERATING ROOM

FIELD OF INVENTION

The present invention relates to a method and a means for supplying clean air to an operating room or similar clean working places.

PRIOR ART

In U.S. Pat. No. 3,626,837 there is disclosed a device for supplying clean air to an operating table or similar. According to said device, the clean air is supplied through an inner ceiling and a laminar flow is directed vertically downwards towards the operating table. At the border areas of said laminar flow, the air is deflected outwards and in the area outside the zone of laminar air there is an area with turbulence. According to said patent specification, said turbulence will never reach the laminar area. However, practical experiencies show that the slightest disturbance of the flow pattern results in the air being contaminated. Already the operation personal and equipment such as an operating lamp, results in substantial disturbances of the ideal pattern such that the static pattern will be missleading in the practical case.

In the Swedish patent specification No. 213 277 there is disclosed a device for maintaining a zone of ventilated air in a room. According to the preferred embodiment the device comprises an air supply device in the ceiling of the room for supplying clean air and a slit surrounding said air supply device, whereby a curtain of air having high velocity surrounds the clean air. The device operates so that the air curtain having high air velocity excludes particles from the area inside the air curtain whereby the air supplied through the air supply device will remain clean.

The device according to said patent specification should operate well in the static case and has been used in practice with a certain success. However, the personal around an operating table will be positioned in said surrounding air curtain and are thus subjected to a strong draught. This may be acceptable, but means at the same time that said placement of the personal will disturb the air curtain and the air will be heavily spread. In certain cases such spreading will mean that particles from the surrounding air may reach inside the air curtain for diminishing the cleaness of the air inside the air curtain.

Moreover, an operating lamp is positioned above the operating table and said lamp entails that the air flow from the air supply device will be disturbed and results in a spreading of said air.

Moreover, the heavy surrounding air curtain means that particles outside said air curtain are ejected by said air flow. There is a risk that such particles subsequently will whirl up a second time inside the air curtain, i.e. in the middle of the clean air flow.

SUMMARY OF THE INVENTION

The object of the present invention is to provide a method and a means for supplying clean air to an operating room or similar in which the drawbacks of the previously known devices have been almost completely eliminated.

In the practically case it is observed that there is almost always an operating lamp positioned right above the operating table. This lamp will of cource disturb the flow pattern. In view thereof and according to the present invention, the clean air is not supplied vertically from above but from the side, either 45° downwards or in a horizontally directed air flow. Embodiments therebetween will of course be plausible.

Fundamental for the invention is the observation that a surrounding air curtain with high air velocity according to the above-mentioned Swedish patent specification No. 213 277 always will be deflected inside towards the clean air positioned therein, since the air supply inside the air curtain takes place with a lower velocity. Thus, ejected particles in the air curtain will pass into the clean air.

According to the present invention, the air is supplied in a strong central air beam or curtain, a so called carry beam, surrounded by side lower velocity. The central carry beam will always eject air from the surroundings thereof. The ejected air will however be said secondary air supplied in said side areas and thus, said ejected air will be clean. Outside the side areas there is air which is contaminated, but said air will never have a possibility of reaching the carry beam with clean air since the contaminated air is rejected or pushed aside by the secondary air in the side areas. Thus, there is a central carry beam fed by clean secondary air, which in turn pushes aside the contaminated air outside thereof.

By means of said central carry beam with high velocity but with a relatively small air amount, the clean air from the secondary air supplier is ejected very far inside the room. In this way, the total air amount in the system can be reduced to maybe the half of known systems or smaller.

According to a preferred embodiment of the invention, the central carry beam is supplied from an air supply member positioned in the corner between the ceiling of the operating room and one side wall and is directed 45° downwards. Thus, the slit is elongated and extends essentially along the complete width of the room. The air curtain or carry beam comprises clean air supplied with relatively high velocity. Along the ceiling and the corresponding side wall, there is secondary air supply members for secondary air having a great extension in the transverse direction and vertical direction, respectively. The secondary air is supplied by said members with a lower flow velocity than the carry beam in order to fill the area under and beside the carry beam so that the carry beam will eject air from said secondary air. Both the carry beam and the secondary air comprises air which is cleaned in a manner known per se by means of sterile filter or similar.

The geometrical placement of the device according to the invention will of course depend on the present application. The application at an operating table of an operating room has been described. The invention may equally well be applied within other areas wherein the demand on clean air is high, such as in drug companies or the process industry.

Thus, the present invention relates to a method for supplying clean or sterile air to an area intended to be kept clean or sterile in an operating room or similar, whereby clean air is supplied to the room through supply members. According to the invention, air is supplied to the room in a central carry beam or air curtain directed towards said area. Moreover, secondary air is supplied in a area surrounding the carry beam, whereby the air velocity in the carry beam is greater than the air velocity of the secondary air. Preferably, the central carry beam has a relatively small extension in the transverse direction while the area with secondary air has a relatively great extension beside the carry beam. The secondary air supplies the carry beam with clean air, i.e. is ejected by the carry beam at the same time as it pushes aside the surrounding contaminated air.

The invention also relates to a means for supplying clean or sterile air to an area intended to be kept clean or sterile in an operating room or similar, whereby clean air is supplied to the room through supply members. The device comprises a central supply member for a central carry beam directed towards said area and at least one secondary air supply member adapted adjacent said central supply member whereby the secondary air supply member is adapted to supply secondary air in an area surrounding the carry beam, whereby the air velocity of the carry beam is greater than the air velocity of the secondary air. Preferably, the central supply member or the central carry beam comprises one or several slits for directing and controlling the carry beam. Preferably, the central supply member is surrounded by the secondary air members on either sides and the air from the secondary members are directed towards the carry beam.

The central supply member may be positioned in a corner about 45° upwards, seen from said sterile area, surrounded by the secondary air members which extend along the ceiling and one of the side walls for forming a mutual angle of about 90°, whereby the carry beam is directed 45° downwards and the secondary air is directed horizontally and vertically, respectively, towards the carry beam.

The secondary air member may comprise an outer angled portion where the secondary air is directed somewhat outwards. Moreover, the secondary air member may be surrounded by plates at the outer sides thereof.

The secondary air member is preferably provided with holes for supplying said secondary air, which holes are dimensioned for supplying the desired air amount with desired velocity.

BRIEF DESCRIPTION OF THE DRAWINGS

The invention is described in more details below with reference to the appended drawings.

DETAILED DESCRIPTION OF THE PREFERRED EMBODIMENT

Figure 1:
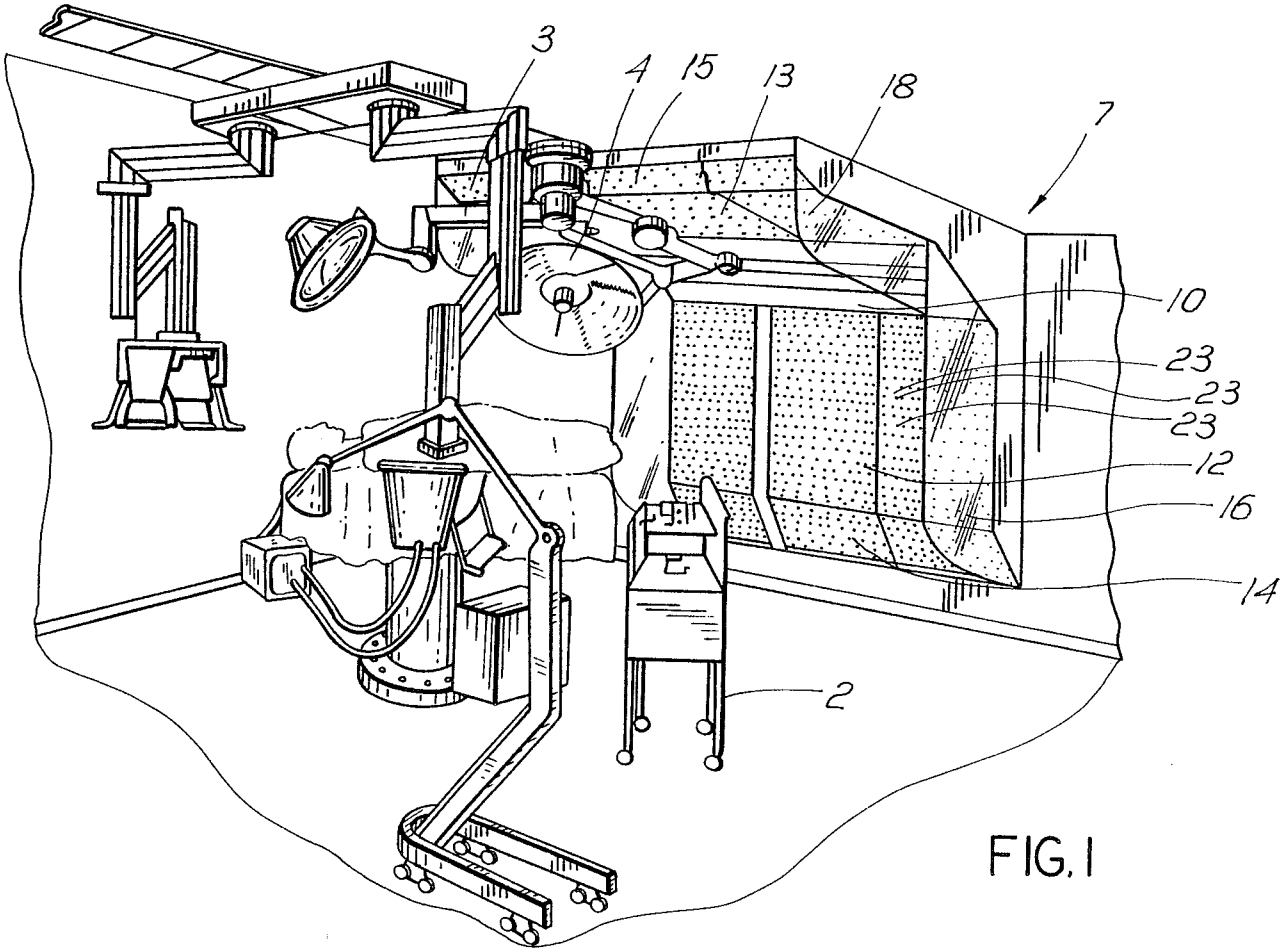
FIG. 1 is a perspective view of an operating room in which a preferred embodiment of the means in accordance with the invention is used.

In FIG. 1 there is shown a typical situation in an operating room during an operation including several persons performing their duty. Several apparatuses surround the patient.

Figure 2:
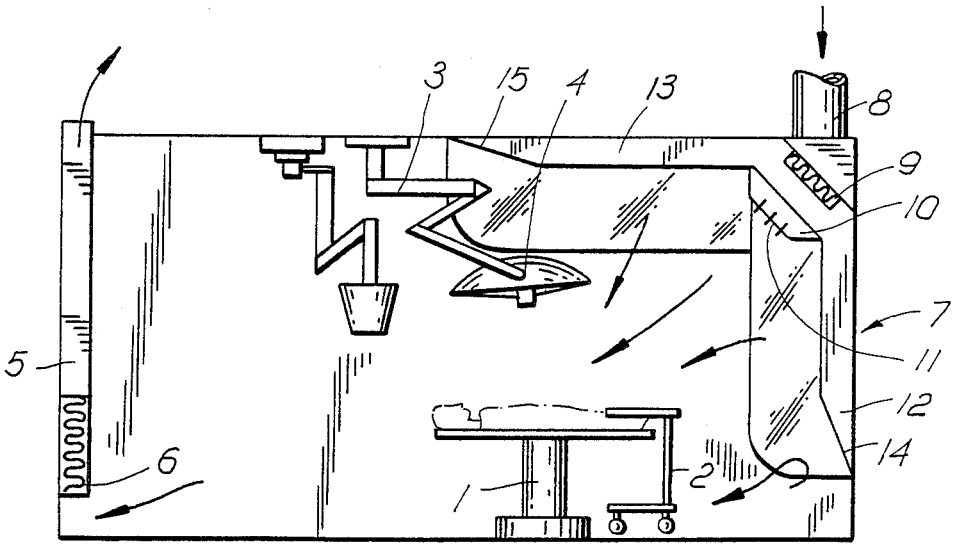
FIG. 2 is a cross-section through the room according to FIG. 1.

In FIG. 2 there is shown a cross-section through the operating room according to FIG. 1, whereby the means according to the invention is shown in cross-section. The air supply means is shown in an operating room for an operation wherein the demands on sterility are high.

Thus, a patient is placed on an operating table 1. A table 2 for sterile instruments are shown to the right of the operating table. In the ceiling, there is attached an arm 3 supporting an operating lamp 4 positioned above the patient. The left portion of the operating room comprises an outlet 5 for output air, which passes through a filter 6 upwards through a conduit. The output air is supplied to a fan means of known type.

In the upper right corner of the room there is an air supply means 7 according to the present invention. An air inlet 8 supplies air to the air supply means from a big ventilation means. A sterile filter or so called absolute filter 9 is placed in the air inlet as clearly appears from FIG. 1. The sterile filter is available for replacement through a lid, which is easily pivoted downwards.

The air supply means 7 according to the invention comprises a first central slit member or supply member 10. The central supply member is positioned in the upper corner of the room as appears from FIG. 1 and comprises longitudinal slits 11. In the embodiment shown there is disclosed three slits but the number of slits can be selected in dependence of the application.

A strong air flow is supplied by said slits and said air flow is directed about 45° downwards towards the clean working area of the room or more precisely towards the operating table. The slits may be shaped for controlling the air flow in different directions. Preferably, the slits form a common strong carry beam or central air curtain directed towards the operation position.

The slits are elongated and extend essentially along the entire width of the room. In certain applications, the width of the slits may be limited in the transverse direction to e.g. 70% or 50% of the width.

It is of course possible to have the carry beam forming other angles towards the horizontal than 45° e.g. from about 10° to about 80°.

The slits may comprise nozzles directing said carry beams in a desired direction, e.g. three beams having a small spreading between the mutual beams.

Along the wall and ceiling adjacent said central supply member 10, there is according to the invention one secondary air supply member 12 and 13, respectively on each side thereof. Said secondary air supply members are fed with the same air as said central supply member and supply sterile air in relatively weak air beams over the entire surface thereof. Said air beams are directed horizontally and vertically, respectively, and meet the central carry beam at different positions and are deliberately ejected by the carry beam. Thus, any air reaching the carry beam from the side and from above will only be said secondary air. Air from the area outside said secondary air zone will never reach the carry beam. Thus, the carry beam will remain clean or sterile during its entire movement towards the operating table. Possible movements of the operating personal will never affect the sterility of the carry beam. Neither will the operating lamp influence on the beam since the beam will pass inclined below the operating lamp.

The flow pattern may be described such that there is a strong central carry beam having high air velocity. This carry beam is elongated in the horizontal direction and is directed 45° downwards. Beside the carry beam, preferably both above and below, there are secondary air beams having lower velocity and directed towards the carry beam, preferably with 45° in relation to the carry beam. Said secondary air beams will be deflected in the same direction as the carry beam and will be ejected by the carry beam. A flow pattern having a laminar or a uniform flow of air will prevail wherein all air is moving 45° downwards. The velocity is highest at the centre and will decrease continuously outwards from the carry beam in both directions. It is obvious that the flow is not laminar in the strict sense. The intention is only to show that the median flow takes place according to said flow lines. The fact that such flow is turbulent will not mean an impairment since the ejected air is clean. 1.

Due to said flow pattern it is required that possible particles outside said controlled flow zone must pass through the entire area of secondary air in which the velocity of the air flow is comparatively uniform and any tendence of flow towards the centre is normally not present at the outer areas. It is very difficult for such outer particles to penetrate the entire secondary air zone and as a result thereof, the carry beam will remain vary clean.

Moreover, the personal possibly entering the area with sterile air will spread said air very little since the personal normally enters the area having low velocity air which gives a low spreading.

The carry beam is placed so that it is disturbed as small as possible by the personal and the fixed and movable equipments, such as instrument tables and the operating lamp etc. This fact ordinary results in that the carry beam is placed in the upper corner of the room as shown in FIG. 2, but other placings may be chosen in other situations.

As an alternative it may be suitable to have the carry beam elongated in the vertical direction whereby the secondary air members are positioned at each adjacent wall, i.e. the supply member for the carry beam is positioned in a corner between two walls and extends vertically from essentially the floor to the ceiling.

Neither is it necessary that the secondary air supply members form a mutual angle of 90° but said angle may be decreased considerably in certain applications to about 60° or yet smaller. In other applications it might instead be necessary to increase the angle between the two secondary supply members to until 120° or more. It is also possible to place the carry beam in a corner surrounded by the ceiling and two side walls so that the carry beam does not have any extension in the transverse direction but is a cylindrical beam or several cylindrical beams.

Finally it is possible in certain applications to replace one of the secondary air supply members with a wall so that the carry beam almost follows a side wall while the secondary air supply member is placed in the ceiling. Other possibilities are obvious to a skilled person such as placing the carry beam straight above the area having the secondary air supply members positioned at the sides thereof angled downwards. This placement may be advantageous in e.g. the process industry where no operating lamp will prevent the air coming from above. In this case the angle between the secondary air supply members may be relatively great, possibly 180° without any drawback.

In FIG. 2 there is shown that the secondary air supply members 12 and 13 are provided with angled portions 14 and 15 which are directed somewhat outwards. Said portions 14 and 15 are provided for rejecting or pushing aside the surrounding air and preventing it from reaching the sterile area. The secondary air beams are delivered orthogonally towards said surfaces and inclined outwards in the room. This portions may be angled about 20o in relation to the main surfaces of the secondary air supply members.

In FIG. 2, the secondary air supply members 12 and 13 are surrounded by transparent plates extending a short length in the room e.g. about 50 cm. Said plates are shown at reference numerals 16, 17, 18, and 19 in FIG. 3. The vertical secondary air supply member extends almost down to the floor and ends e.g. 0.5 m above the floor as shown in the figure.

Figure 3:
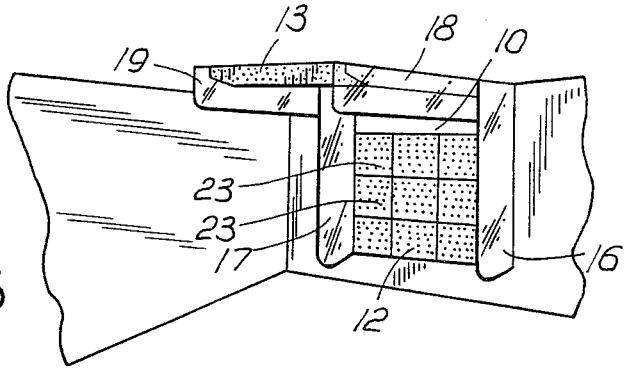
FIG. 3 is a perspective view of the preferred embodiment according to the invention.

From FIG. 3 it appears that the secondary air supply member may be divided in panels having a size of about 1 m×1 m. Each panel is provided with a number of small holes 23 dimensioned to supply the air amount desired. Normally, the air amount is uniform over all panels. The intention is also that for exemple such panels positioned on a great distance from the carry beam may have smaller holes for supplying a smaller amount of air having lower velocity. In this way it is possible to control the velocity profile of the secondary air as desired The holes may also be directed in different directions in order to give the same operations as the angled portions 14 and 15 described above.

Figure 4:
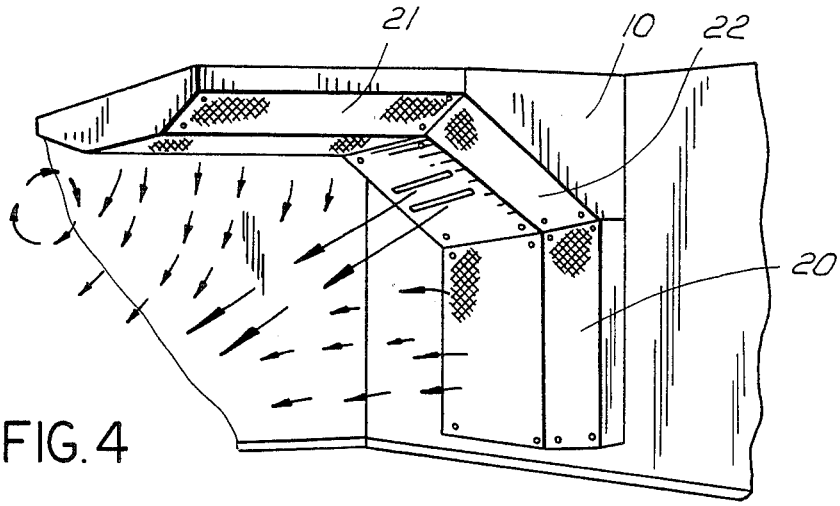
FIG. 4 is a perspective view of an alternative embodiment of the invention.

It is also possible to replace the side walls shown in FIG. 3 or the plates 16–19 with angled portions along the corresponding side edges supplying secondary air beams inclined outwards in order to reject or push aside the air which has a tendence to reach the carry beam, as shown in FIG. 4 at 20, 21 and 22. In FIG. 4, the angle portions 14 and 15 have been left out and the system may very well operate without any angled portions or plates For the flow pattern it is not necessary to use such plates 16–19 but it may be recommendable to use such walls or plates in order to limit the personal to be within the sterile area. Such so called dicipline walls may in that case extend longer into the room than shown in FIG. 3. Dicipline walls may also be movable walls of plexiglass or similar which are attached when needed and can also be push walls.

Figure 5:
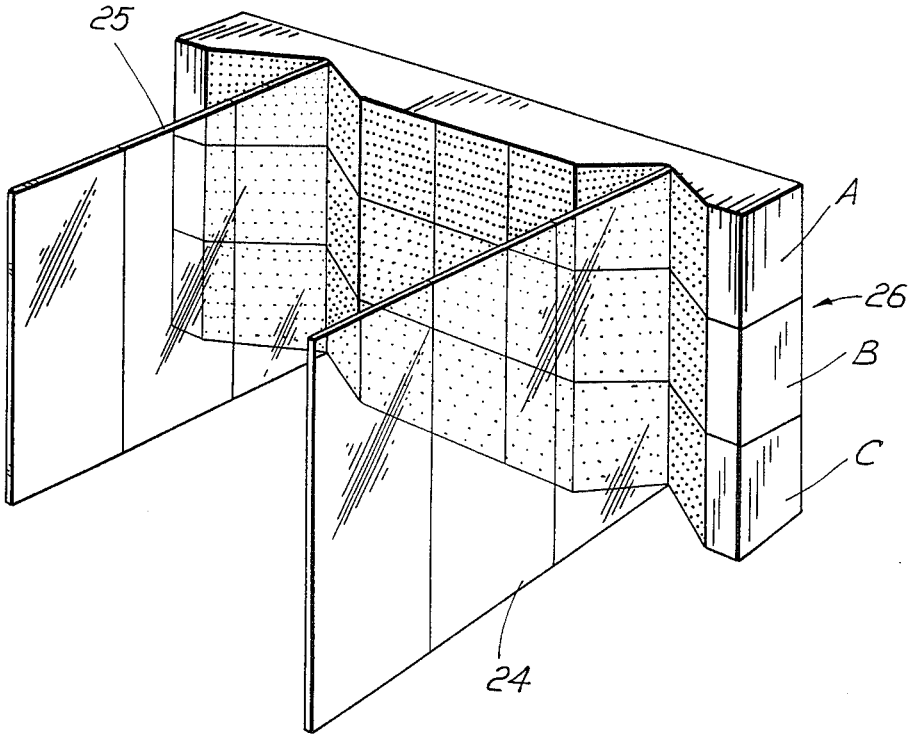
FIG. 5 is a second alternative embodiment of the invention.

In FIG. 5 there is shown another improvement of the system according to the invention, whereby the walls 16, 18 and 17, 19 shown in FIG. 3 have been extended inside the operating room in order to completely surround the operating table. Outside said protection walls 24 and 25 and adjacent the supply members according to the invention there are stacked three separate fans 26 which recirculate a portion of the air in order to increase the total air recirculation in the working area. In FIG. 5 there is shown only the vertical secondary air supply member but it is realised that both the supply member for the carry beam and the secondary supply member in the ceiling should be included in this system, but these components have been left out in the figure.

This extra recirculation of air is possible since the sterile filter is positioned in the module itself and thus, it is no drawback to recirculate air from the room. The separate fans 26 are provided with filters at the inlets thereof in order to prevent textile particles and other particles from entering the system.

With said extra recirculation it is possible to achieve conditions which approaches that for an operating cabin.

In FIG. 1 there is shown a typical situation at an operation with several persons making their own tasks. Several apparatuses surround the patient. By placing the supply air means according to the invention in the corner as shown it is possible for the carry beam to reach the operation area without being disturbed by apparatuses or the working personal.

Experiments have shown that the air amount supplied may be decreased to less than half of that used with equipments of today while at the same time maintaining or increasing the sterility. This means a considerable advantage since the heavy air flows used up to now emit a heavy noise which is tiring for the operating personal and reduce the power of concentration.

Moreover, experiments have shown that the sterility of the air is not influenced at all, according to the present invention, by the activity of the personnel during an operation while previously used systems show a considerable influence of the activity of the personnel. Thus, the sterility may be maintained at an improved level by the present invention.

Furthermore, the means according to the invention results in a reduction of the channel system between the room and a the fan system.

By means of the invention, the costs for supplying sterile air may be halved.

The means according to the invention is a module system intended for rebuilding of hospitals from the 1950's and 1960's whereby the channel systems of such hospitals may be used.

Hereinabove, a preferred embodiment of the invention and certain variants thereof have been described. However, it is obvious to a skilled person that the invention may be modified in many respects within the scope of the appended patent claims, and the intention is that the invention shall comprise all such modifications.

I claim:

1. A method for supplying clean or sterile air to an area intended to be kept clean or sterile in an operating room, the method comprising the steps of supplying a central primary narrow carry beam of clean air towards said area;

supplying flows of clean secondary air on either side of the carry beam;

the secondary air on either side of the carry beam initially being directed towards the carry beam and then deflected essentially parallel to the carry beam;

said carry beam essentially being directed along the intersection of the secondary air flows;

the air velocity of said carry beam being greater than the air velocity of said secondary air.

2. A method according to claim 1, said secondary air feeding said carry beam from either sides with clean air by ejection by said carry beam and at the same time confining the carry beam and pushing aside the surrounding contaminated air.

3. A means for supplying clean or sterile air to an area intended to be kept clean or sterile in an operating room, comprising:

a primary central supply member (10) for a central clean air primary narrow carry beam directed towards said area; and secondary air supply member (12, 13) adapted on either sides of said central supply member (10), said secondary air supply members (12, 13) being adapted to supply clean secondary air in an area surrounding said carry, beam;

the air velocity or the carry beam being greater than the air velocity of the secondary air;

the secondary air on either side of the carry beam initially being directed towards the carry beam and then deflected essentially parallel to the carry beam;

said primary central supply member (10) directing said carry beam essentially along the intersection of the secondary air flows.

4. A means according to claim 3, wherein the area of said central carry beam has a relatively small transverse extension while the areas of secondary air have a relatively great extension.

5. A means according to claim 3, wherein said central supply member (10) for the carry beam comprises one or several slits (11) for directing and supplying the carry beam, said slits being elongated in the horizontal direction.

6. A means according to claim 3, wherein said central supply member (10) is positioned in a corner of the room about 45° upwards seen from said sterile area and is surrounded by said secondary air supply members (12, 1) which extend along the ceiling and one side wall for forming a mutual angle of about 90°, said carry beam being directed 45° downwards and said secondary air being directed horizontally and vertically, respectively towards the carry beam.

7. A means according to claim 3, wherein said central supply member (10) is positioned in a corner of the room about 45° upwards seen from said sterile area and is surrounded by three secondary air supply members (12, 13) extending along the ceiling and two side walls for forming a mutual angle of about 90°, said carry beam being a cylindric beam and said secondary air being directed horizontally, horizontally and vertically, respectively towards the carry beam.

8. A means according to claim 3, wherein said secondary air supply member (12, 13) comprises an outer angled portion (14, 15, 20, 21, 22) in which secondary air is directed somewhat outwards.

9. A means according to claim 3, wherein each secondary air supply member (12, 13) at the outer side thereof is surrounded by a plate (16, 17, 18, 19).

10. A means according to claim 3, wherein said secondary air supply members (12, 13) are provided with holes for supplying said secondary air, said holes being dimensioned for supplying the desired air amount with the desired velocity.

11. A method of supplying clean or sterile air to a zone to be kept clean or sterile, the method comprising:

directing a primary stream of clear air into a zone to be kept clean or sterile; and directing secondary steams of clean air respectively towards opposite sides of the primary stream for deflection thereby essentially into parallel with the direction of the primary stream, the primary steam having a greater velocity than the secondary streams.

* * * * *